US007980190B2

(12) United States Patent
Kim et al.

(10) Patent No.: US 7,980,190 B2
(45) Date of Patent: Jul. 19, 2011

(54) DEEP DRAFT SEMI-SUBMERSIBLE LNG FLOATING PRODUCTION, STORAGE AND OFFLOADING VESSEL

(75) Inventors: Jang Kim, Spring, TX (US); Jim O'Sullivan, Houston, TX (US); Atle Steen, Holden Beach, NC (US)

(73) Assignee: Technip France, Courbevoie (FR)

( * ) Notice: Subject to any disclaimer, the term of this patent is extended or adjusted under 35 U.S.C. 154(b) by 458 days.

(21) Appl. No.: 12/247,355

(22) Filed: Oct. 8, 2008

(65) Prior Publication Data

US 2009/0158986 A1 Jun. 25, 2009

Related U.S. Application Data

(60) Provisional application No. 61/015,776, filed on Dec. 21, 2007.

(51) Int. Cl.
*B65D 88/78* (2006.01)

(52) U.S. Cl. ..... 114/256; 114/264

(58) Field of Classification Search ..... 114/256, 114/264, 265, 266, 267; 405/203, 204, 208, 405/209, 224, 205, 206, 207
See application file for complete search history.

(56) References Cited

U.S. PATENT DOCUMENTS

| | | | | |
|---|---|---|---|---|
| 4,059,065 | A * | 11/1977 | Clark et al. | 114/256 |
| 4,170,954 | A * | 10/1979 | Rinaldi | 114/265 |
| 4,498,412 | A * | 2/1985 | Liden | 114/264 |
| 5,833,397 | A | 11/1998 | Horton, III | |
| 6,206,614 | B1 * | 3/2001 | Blevins et al. | 405/224 |
| 7,140,317 | B2 * | 11/2006 | Wybro et al. | 114/264 |

FOREIGN PATENT DOCUMENTS

| | | |
|---|---|---|
| EP | 0335928 | 10/1989 |
| GB | 2003798 | 3/1979 |
| GB | 2118904 | 11/1983 |

OTHER PUBLICATIONS

R. Blazquez Lainez, International Search Report for International Patent Application No. PCT/US/2008/087700, European Patent Office, dated Jul. 29, 2010.

R. Blazquez Lainez, Written Opinion for International Patent Application No. PCT/US/2008/087700, European Patent Office, dated Jul. 29, 2010.

* cited by examiner

*Primary Examiner* — Lars A Olson
(74) *Attorney, Agent, or Firm* — Locke Lord Bissell & Liddell LLP

(57) ABSTRACT

The present disclosure provides a method, apparatus, and system of a deep-draft semi-submersible hydrocarbon, such as for liquefied natural gas (LNG), floating production and storage vessel that can include a pontoon containing hydrocarbon tanks, fixed ballast at the bottom in a double-bottom portion, and segregated ballasted tanks with variable ballast located generally above the fixed ballast portion that can assist in keeping the pontoon submerged during various storage levels. Multiple vertical columnar supports can penetrate the pontoon from top to bottom and extend above the water surface to support a deck, including various topside structures. An intermediate double-deck on the top of the pontoon can provide access to the tanks, for example, through the vertical columnar supports. The double bottom structure, deck, and vertical columnar supports can provide overall structural integrity.

18 Claims, 5 Drawing Sheets

DEEP DRAFT SEMI-SUBMERSIBLE LNG FLOATING PRODUCTION, STORAGE AND OFFLOADING VESSEL

CROSS REFERENCE TO RELATED APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND

1. Field of the Invention

The invention relates to floating offshore vessels. More specifically, the invention relates to floating offshore vessels designed for at least the storage of hydrocarbon products.

2. Description of Related Art

A Floating Production, Storage and Offloading vessel (FPSO; also called a "unit" and a "system") is a type of floating tank system used by the offshore oil and gas industry and designed to take all of the oil or gas from nearby oil and gas wells, process it, and store it until the oil or gas can be offloaded onto waiting tankers, or sent through a pipeline. The temporary storage allows production from subsea operations to accumulate until a sufficient quantity is available to offload to a tanker for transportation to the mainland.

A number of different designs with various advantages and disadvantages populate the industry. Some FPSO structures are decommissioned tankers that are suitable for large fixed storage. Some FPSO structures are designed to be submerged partially below the water surface as a semi-submersible structure. One advantage of semi-submersible units for oil storage is lowering the pitch and roll from wave action by having more structure below the surface. For such structures, it is generally known to support a working deck above the water surface when the semi-submersible is at its lowest normal submersion level. Such FPSOs traditionally have at least partially submerged the storage tanks for oil and built columnar supports from the tanks upward to support the deck above the water surface.

However, recent efforts in the oil and gas industry have focused on liquefied natural gas (LNG) with particular requirements. LNG is natural gas that has been converted to liquid form for ease of storage or transport. The liquefaction process involves removal of certain components (such as dust, helium, or impurities that could cause difficulty downstream, e.g. water, and heavy hydrocarbons) and then condensed into a liquid at close to atmospheric pressure by cooling it to cryogenic temperatures. LNG is transported in specially designed cryogenic sea vessels and stored in specially designed tanks. LNG is about 1/614th the volume of natural gas at standard temperature and pressure (STP), making it much more cost-efficient to transport over long distances where pipelines do not exist. Currently, common tank types are membrane (TGZ Mark III and GT96) and Moss Rosenberg (spheres) or Self-Supporting Prismatic Type. Among them, membrane-type LNG tanks are most widely used because of its lower material and fabrication cost. However, it is a general consensus that membrane-type LNG tanks may not sustain sloshing impact load at partial filling condition unless roll motions of the carrier are very small, i.e. less than 5 degrees. LNG FPSOs are needed to operate at all filling levels. Ship-type FPSOs have significant roll motion response in waves and are ill-suited to fulfill the requirement for small roll motion in most of the potential installation sites for LNG FPSOs.

In addition to the sloshing issue, there is a stricter requirement on motion response of LNG FPSO regarding LNG liquefaction plant to be placed on the topsides of the FPSO. Most of the well-proven high efficiency LNG liquefaction technology requires heel angle of the hull as small as 2 degrees during the FPSO operation. The existing designs of ship-type and semi-submersible FPSOs can hardly meet these criteria.

FPSO hulls for LNG applications, especially for membrane-type LNG tanks, also can have higher structural requirements as compared to oil-storage application. The structural integrity of insulation system structures and connections between insulation systems and hulls is sensitive to the local deflection and vibration of the tank hull. It is highly desirable that possible major structural loads, such as vertical shear force and bending moment due to topside weight and wave load, are not directly transferred to the tank wall structures.

Although less critical than the requirements on hull motion and structural integrity, capability of float-over installation for topsides will be another desirable aspect of LNG FPSO hull. In case of a ship-type FPSO, the high freeboard of FPSO limits use of float-over installation of topsides, which results in longer construction periods in dry dock and quayside. In case of semi-submersible types, spacing between columns needs to be wide enough for installation vessels to pass through. Further, enough ballasting capacity is needed to lower the freeboard to the required level during the installation.

To provide safer storage of LNG cargo and more flexible options for construction, installation and operation of LNG facilities, a new hull design is needed that can provide smaller motion response in waves and smaller footprints on and above the mean water level. It is also desirable for the new design that the hull shape and arrangement should be able to provide sufficient structural integrity to support loads above the storage area without interfering with LNG tank structures.

BRIEF SUMMARY

The present disclosure provides a method, apparatus, and system of a deep-draft semi-submersible hydrocarbon, such as for liquefied natural gas (LNG), floating storage vessel that includes a pontoon containing hydrocarbon tanks, a fixed ballast at the bottom in a double-bottom portion, and segregated ballasted tanks with variable ballasts located generally above the fixed ballast portion that assist in keeping the pontoon submerged during various storage levels. Multiple vertical columnar supports penetrate the pontoon from top to bottom and extend above the water surface to support a deck, including various topside structures. An intermediate double-deck on the top of the pontoon can provide access to the tanks, for example, through the vertical columnar supports. The double bottom structure, deck, and vertical columnar supports can provide overall structural integrity.

The disclosure provides a semi-submersible floating storage vessel, comprising: a fixed ballast portion disposed at a first elevation; a liquefied natural gas storage tank disposed at a second elevation above the first elevation and coupled to the fixed ballast portion; a columnar support vertically coupled to the fixed ballast portion and disposed between the first elevation and a third elevation above the second elevation; a variable ballast portion disposed above the first elevation and coupled to the storage tank; and a deck coupled to the columnar support and disposed above the third elevation.

The disclosure provides design changes and improvements from the conventional ship-type FPSO and semi-submersibles to minimize motion response and maximize the structural integrity for LNG application. With the deep draft, small water plane area, low center of gravity and large radius of gyration, the new LNG FPSO offers very low motions on the topsides and in the LNG cargo tanks. This provides more options and flexibilities in the selection of LNG liquefaction units, LNG containment systems, construction sites, installation methods, mooring systems (i.e. no needs for weathervaning), and less down time compared with conventional ship-type FPSO hulls.

BRIEF DESCRIPTION OF THE DRAWINGS

While the concepts provided herein are susceptible to various modifications and alternative forms, only a few specific embodiments have been shown by way of example in the drawings and are described in detail below. The figures and detailed descriptions of these specific embodiments are not intended to limit the breadth or scope of the concepts or the appended claims in any manner. Rather, the figures and detailed written descriptions are provided to illustrate the concepts to a person of ordinary skill in the art as required by 35 U.S.C. §112.

DETAILED DESCRIPTION

One or more illustrative embodiments of the concepts disclosed herein are presented below. Not all features of an actual implementation are described or shown in this application for the sake of clarity. It is understood that the development of an actual embodiment, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill in the art having benefit of this disclosure.

Figure 1:
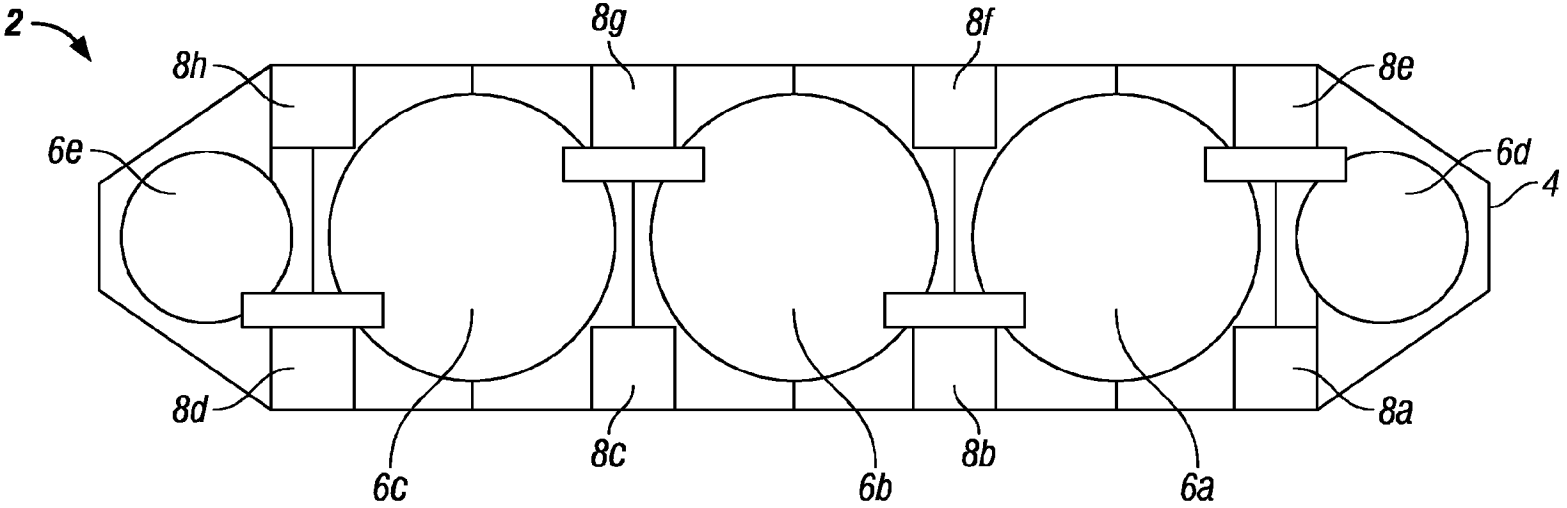
FIG. 1 is a schematic top view of an exemplary embodiment of a floating storage vessel described herein.
Figure 2:
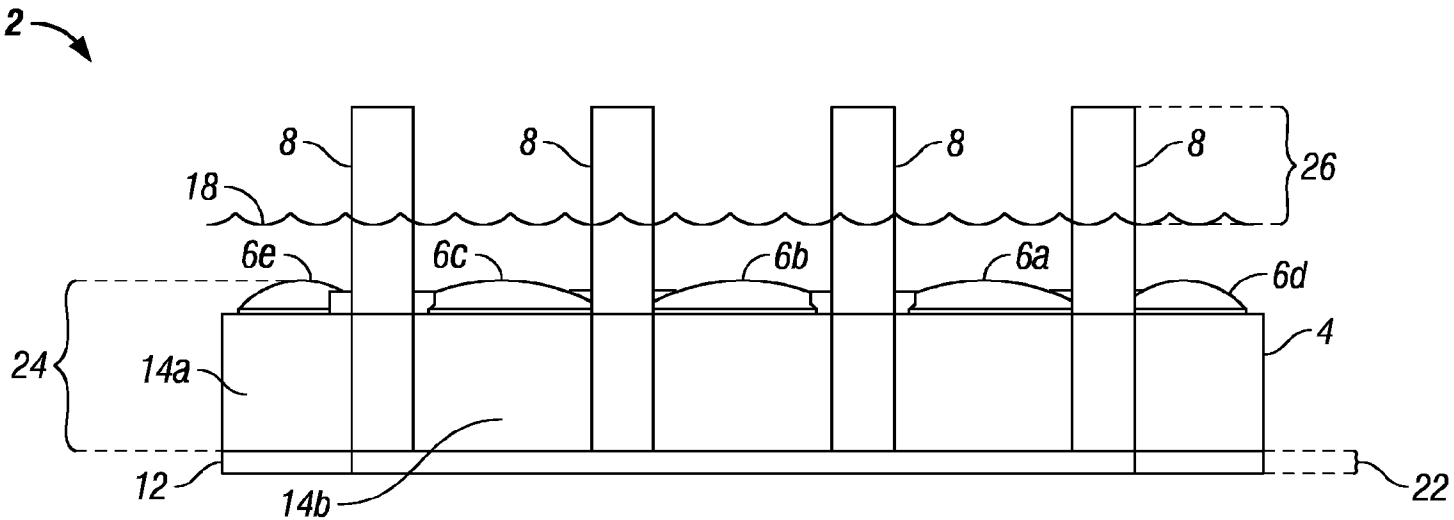
FIG. 2 is schematic side view of the vessel of FIG. 1, showing a fixed ballast portion, tanks, variable ballast portions, and columnar supports.

FIG. 1 is a schematic top view of an exemplary embodiment of a floating storage vessel described herein. FIG. 2 is schematic side view of the vessel of FIG. 1, showing a fixed ballast portion, tanks, variable ballast portions, and columnar supports. The figures will be described in conjunction with each other. A floating storage vessel 2, which can include a floating production, storage, and offloading vessel (FPSO), and other vessels that can temporarily store hydrocarbons and especially liquefied natural gas can be formed with a pontoon 4. The vessel 2 generally includes at least one storage tank 6 disposed internal to the outer periphery of the pontoon 4. The tank 6 can be suitable for the particular hydrocarbon stored, such as LNG. If used for LNG, the vessel 2 can have appropriate equipment, insulation, and facilities to keep the tank 6, for example, at the cryogenic temperatures necessary for LNG. Such equipment is known to the art and is not deemed necessary to be described herein for one with ordinary skill in the art. Further, the various ancillary equipment, structural details, weldments, ladders, cranes, crew facilities, production and processing equipment, and other equipment are not shown or described in detail, as such would be deemed to be well within the ordinary skill of one in the art, but would be included in the commercial embodiment of the invention.

One or more columnar supports 8 can be disposed around the periphery of the tanks 6. In the exemplary embodiment, eight columnar supports are illustrated, although the number can be fewer or greater. For instance, the columnar supports can include columnar supports 8*a*-8*h* (collectively "supports 8") disposed between three central tanks 6*a*, 6*b*, and 6*c*, and two end tanks 6*d* and 6*e* (collectively "tanks 6").

In elevation, as shown in FIG. 2, the vessel 2 generally can include a fixed ballast portion 12 as one of the lowest structures of the vessel at a first elevation 22, such as a sub-sea elevation, for example some distance below the water level or surface of the sea. Generally, the fixed ballast portion 12 will be a double-bottom structure such that there is generally a top and bottom plating that is at least partially filled with fixed ballast. The fixed ballast can be any number of materials generally heavy in weight such as concrete, iron ore, and the like, singularly or in combination.

Above the first elevation 22, the storage tanks 6 can be disposed at a second elevation 24, which can be sub-sea or above the sea surface, in whole or in part. The storage tanks can be supported by or otherwise coupled to the fixed ballast portion 12. Further, the columnar supports 8 can be coupled to the fixed ballast portion 12 and extend above the second elevation 24 to a third elevation 26, for example above the sea surface or water level. The vessel 2 can further include at least one variable ballast portion 14. For example, a variable ballast portion 14*a* can be disposed around the end tank 6*e*, and another variable ballast portion 14*b* can be disposed around the tank 6*c*. Other variable ballast portions can be disposed throughout the vessel above the fixed ballast 12 at the first elevation 22. Advantageously, it is believed that a variable ballast portion 14 net volume capacity should be about one-half of the hydrocarbon storage capacity by volume.

Figure 3:
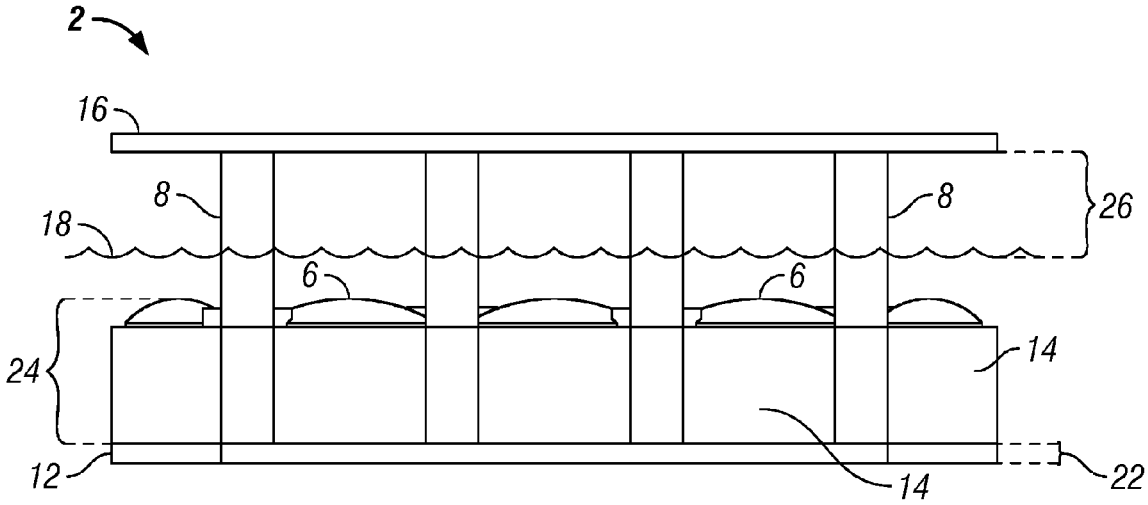
FIG. 3 is a schematic side view of the vessel of FIG. 2, showing a semi-submerged state of the vessel.

FIG. 3 is a schematic side view of the vessel of FIG. 2, showing a semi-submerged state of the vessel. The fixed ballast 12 at the first elevation 22 with the tank 6 and variable portions 14 at elevation 24 are shown submerged below a water level 18. The columnar supports 8 can extend above the water level 18 to the third elevation 26. The deck 16 can be disposed above the third elevation 26. The deck 16 can support various topside elements, such as production facilities, crew quarters, control stations, and other elements generally known in the field.

Advantageously, the vessel 2 can have a low center of gravity due to a large amount of fixed ballast 12 and can have a smaller water plane area than conventional LNG vessels, for example due to most of the structure being submerged with the relatively small cross-sectional area of the columnar supports 8 being the primary structure exposed to the surface water. The heavy weight and smaller water plane area can provide the vessel 2 with a lower overall roll and better pitch response. Thus, the motion, including sloshing of the stored hydrocarbons, can be less than conventional floating-type LNG vessels.

The columnar loads from the columnar supports 8 can be directed toward the fixed ballast portion 12 and not the storage tanks 6, for example. Thus, the storage tanks 6 between each columnar support 8 can be surrounded by a free space that can be used, for example, as variable ballast portions 14, which can at the same time protect the storage tanks 6. Offshore structures, such as the tanks 6, can be made from, for example, layers of insulation sandwiched between thin layers of stainless steel and can be fragile. Accordingly, it can be advantageous to surround at least some portion of a tank 6 with a variable ballast portion 14 to help protect the tank 6 against punctures or other threats to the integrity of the tank wall or hull.

When the volume of hydrocarbons in one or more storage tanks 6 changes, the variable ballast tanks 14 can be ballasted with, for example, water, in order to keep a desired draft. That is, water, for example, can be added to or removed from one or more ballast tanks 14, which can influence the depth of at least a portion of the vessel 2, such as the depth of the fixed ballast 12, below the water line or sea surface. For example, when the storage tanks 6 are not completely full, the variable ballast tanks 14 can be ballasted by increasing the volume of water therein to achieve a first desired draft. As another example, when the storage tanks 6 are full, the variable ballast portions 14 can be ballasted by decreasing the volume of liquid therein, such as to achieve a second desired draft, which can be the same or different from the first draft. Any change in volume of a tank 6 or ballast tank 14 can occur at any time, singularly or in combination, and can occur in any order, including simultaneously.

Figure 4:
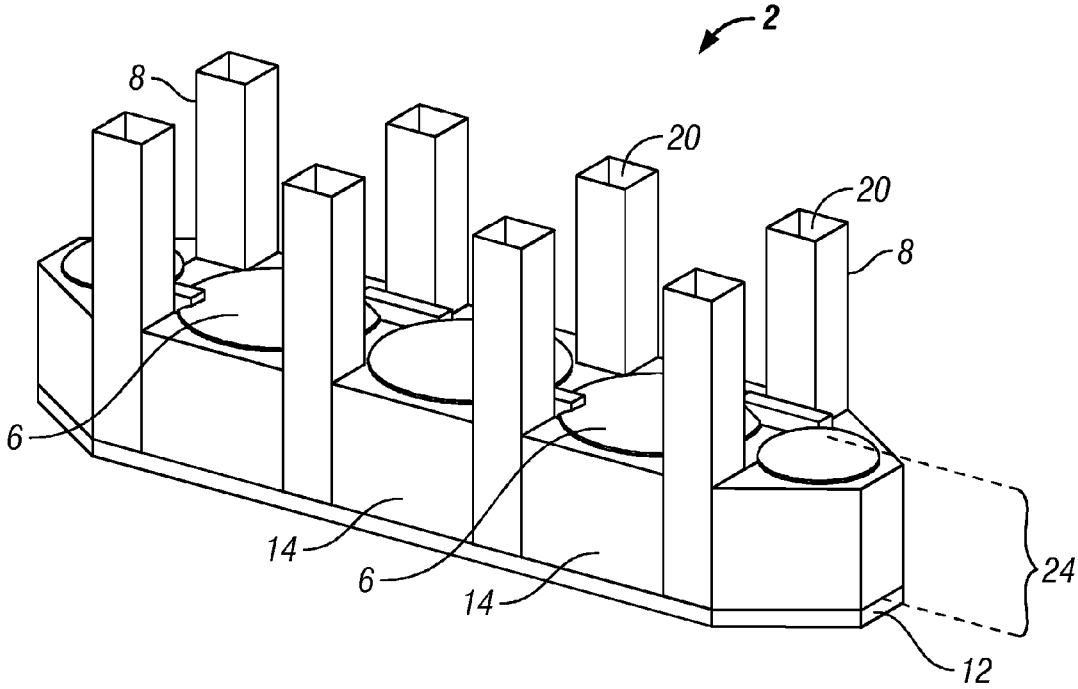
FIG. 4 is schematic top perspective view of the vessel of FIG. 1.

FIG. 4 is a schematic top perspective view of the vessel of FIG. 1. While a large percentage of the variable ballast portion 14 can be disposed generally at the second elevation 24, a variable ballast portion can be integrated with the columnar supports 8, which may be open or closed, sealed or otherwise, in whole or in part. For example, the columnar supports 8 generally include columnar inner volumes 20. The volume 20, or at least a portion of the volume, can be used for variable ballast. The variable ballast can extend vertically along one or more subsections of the columnar support 8, or portions thereof. As another example, the columnar inner volume 20, or a portion thereof, can be used for access by personnel and others to other areas of the vessel.

Figure 5:
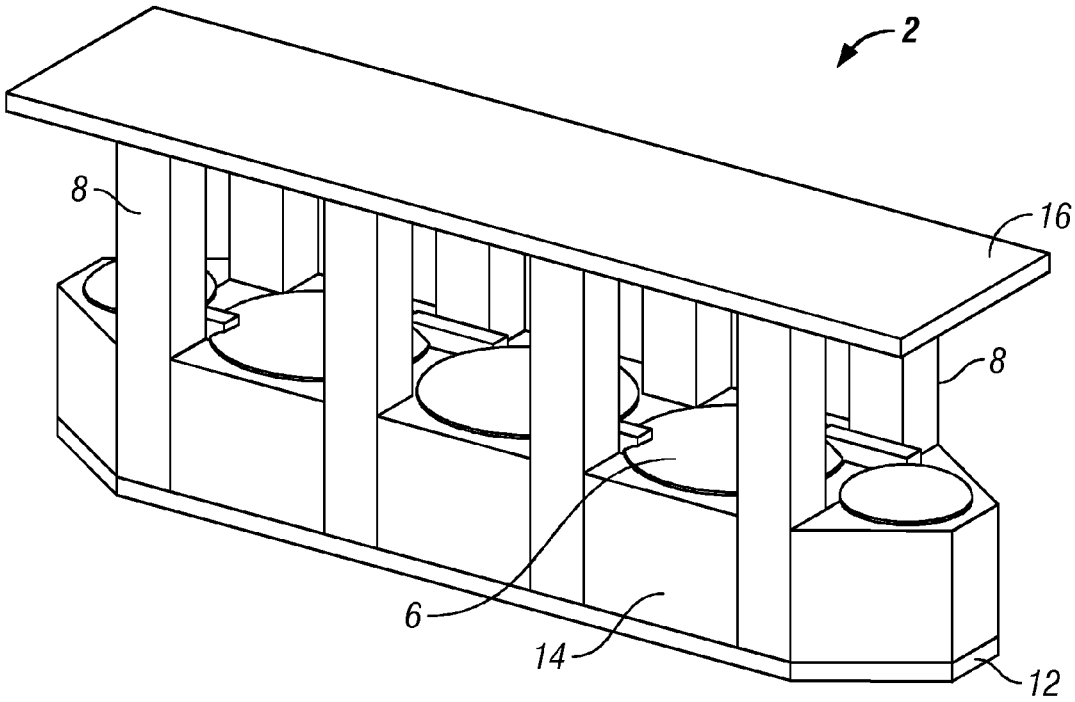
FIG. 5 is a schematic top perspective view of the vessel of FIG. 1, showing a deck disposed above the columnar supports.

FIG. 5 is a schematic top perspective view of the vessel of FIG. 1, showing a deck disposed above the columnar supports. The deck 16 is shown supported above the columnar supports 8, which generally can be above the water level or sea surface as described earlier. The full length columnar supports 8 can provide columnar support extending downward to the relatively heavy fixed ballast portion 12. The vessel 2 has a low center of gravity with the fixed ballast 12, variable ballast 14 and liquid stored in the tanks 6, which can provide stability to the deck 16.

Figure 6:
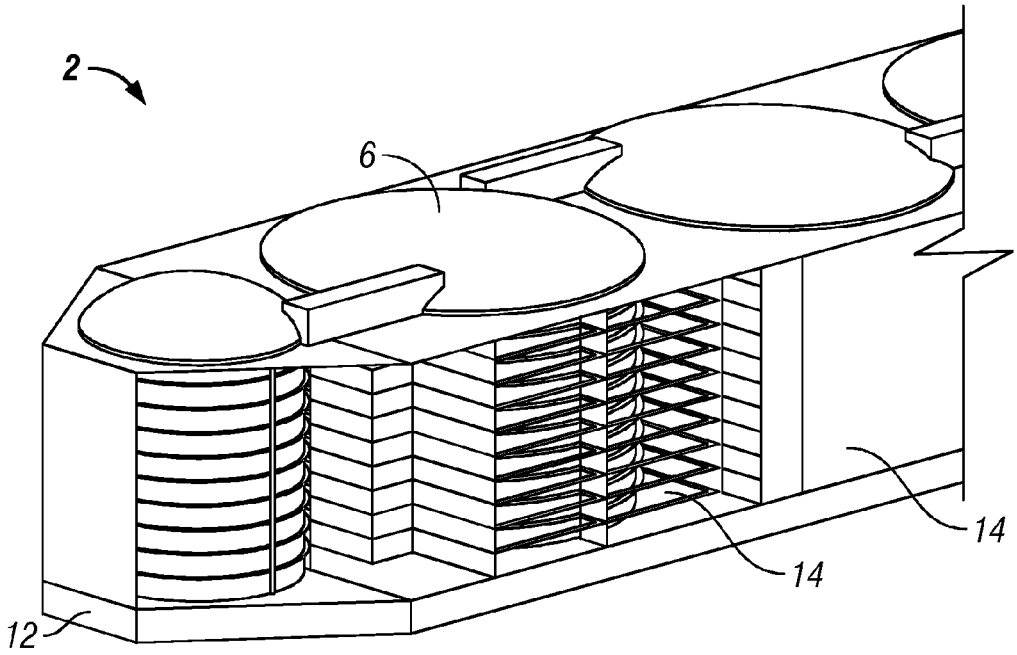
FIG. 6 is a schematic top perspective view of the vessel of FIG. 1, showing an exemplary portion of an internal structure.

FIG. 6 is a schematic top perspective view of the vessel of FIG. 1, showing an exemplary portion of an internal structure. This diagram illustrates internal structures that can provide spaces into which one or more variable ballast portions 14 can be formed. Thus, the variable ballast 14 can be situated in such spaces surrounding the tank 6 for any number of purposes, such as protection, insulation or, as another example, variable ballasting.

Figure 7:
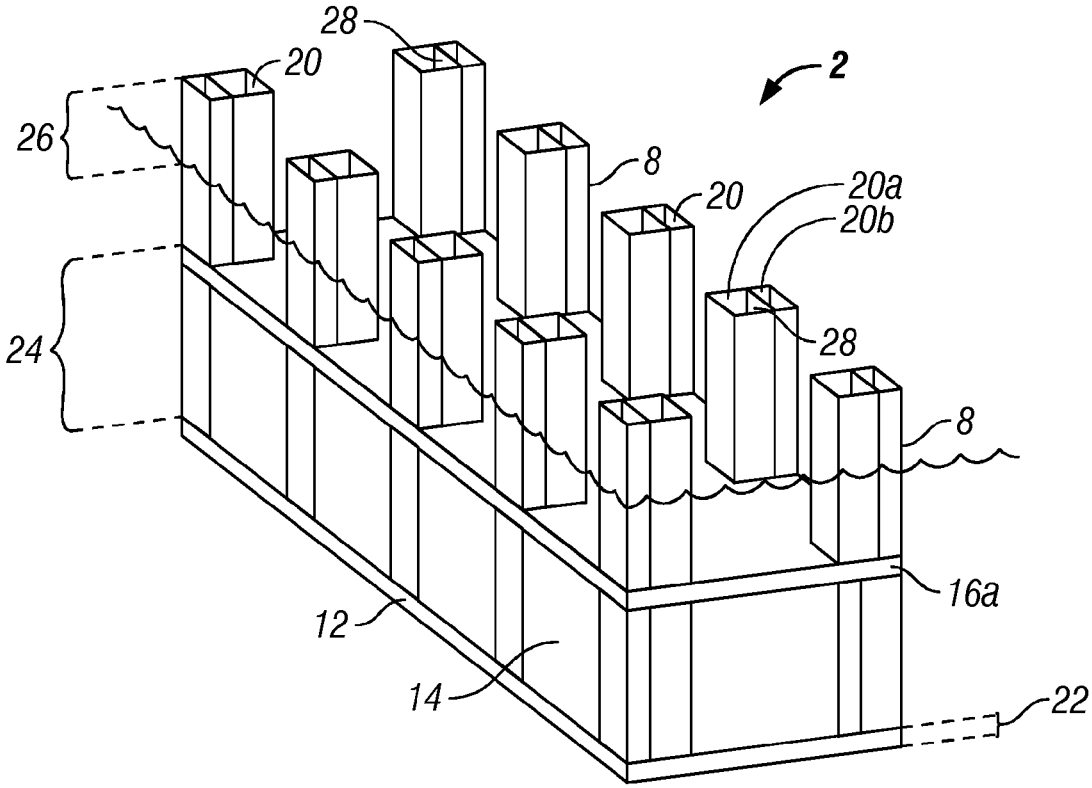
FIG. 7 is a schematic top perspective view of another embodiment of the vessel.
Figure 8:
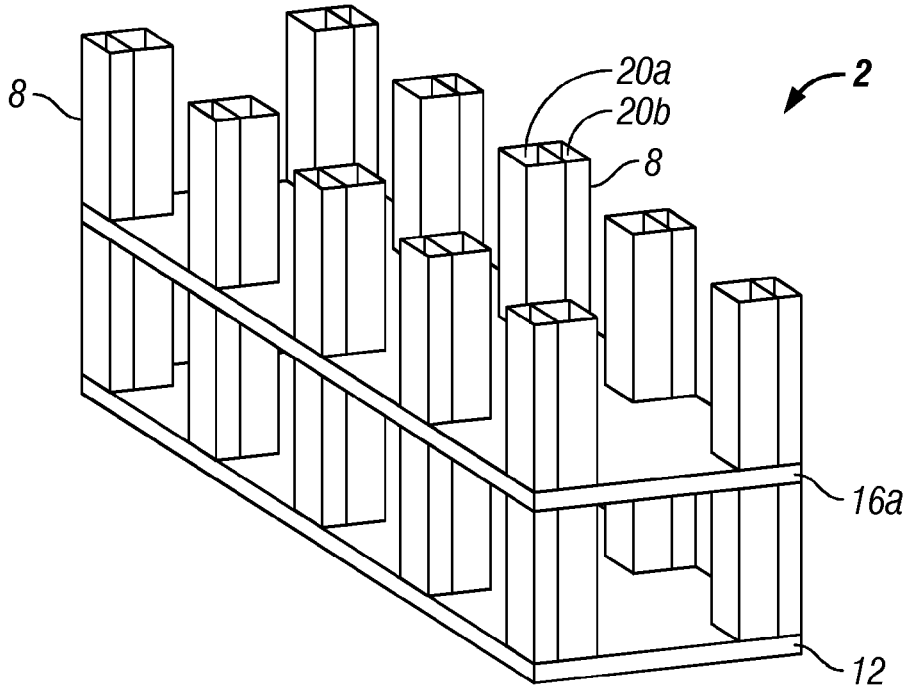
FIG. 8 is a schematic top perspective view of the vessel of FIG. 7, showing structural and ballast details.

FIG. 7 is a schematic top perspective view of another embodiment of the vessel. FIG. 8 is a schematic top perspective view of the vessel of FIG. 7, showing structural and ballast details. The drawings will be described in conjunction with each other. This embodiment can include various features described above and can be more rectangular in shape. In general, the elements can be structurally similar. For example, the fixed ballast portion 12 can be at a first elevation 22. The variable ballast portion 14 can be at a second elevation 24, such as above the fixed ballast portion 12. The storage tanks are not shown in these two figures and generally can be internal to the variable ballast portion 14. The variable ballast portion 14 can be disposed between the columnar supports 8 that surround the various tanks disposed therein. The columnar supports 8 can extend from the fixed ballast portion 12 at the first elevation 22 through the second elevation 24 to the third elevation 26 upon which a structure, such as deck 16 shown in FIGS. 3 and 5, can be formed. Further, the columnar supports 8 can include columnar partitions 28, which can form a plurality of vertical spaces 20*a*, 20*b* (collectively "spaces 20") within the columnar support 8. The spaces 20 formed by the partition 28 can be used as an access to below deck structures as described below. As another example, one or more spaces 20 can be used as additional variable ballast portions 14.

The storage tanks can be disposed between an intermediate deck 16*a* and the fixed ballast portion 12. The intermediate deck 16*a* can be, for example, a double-deck structure having a top plate and bottom plate with a space disposed therebetween. The space can be used as a work space or maintenance space of sufficient height and strength to allow access by personnel and equipment to the storage tanks 6 disposed at the second elevation 24. Thus, access can be gained from the top deck 16, shown in FIG. 5, through the columnar support 20 into the intermediate deck 16*a*, even when the deck 16*a* is submerged under water. Thus, maintenance and other procedures can be carried out on the vessel, in at least one embodiment, by access through the columnar supports 8.

Figure 9:
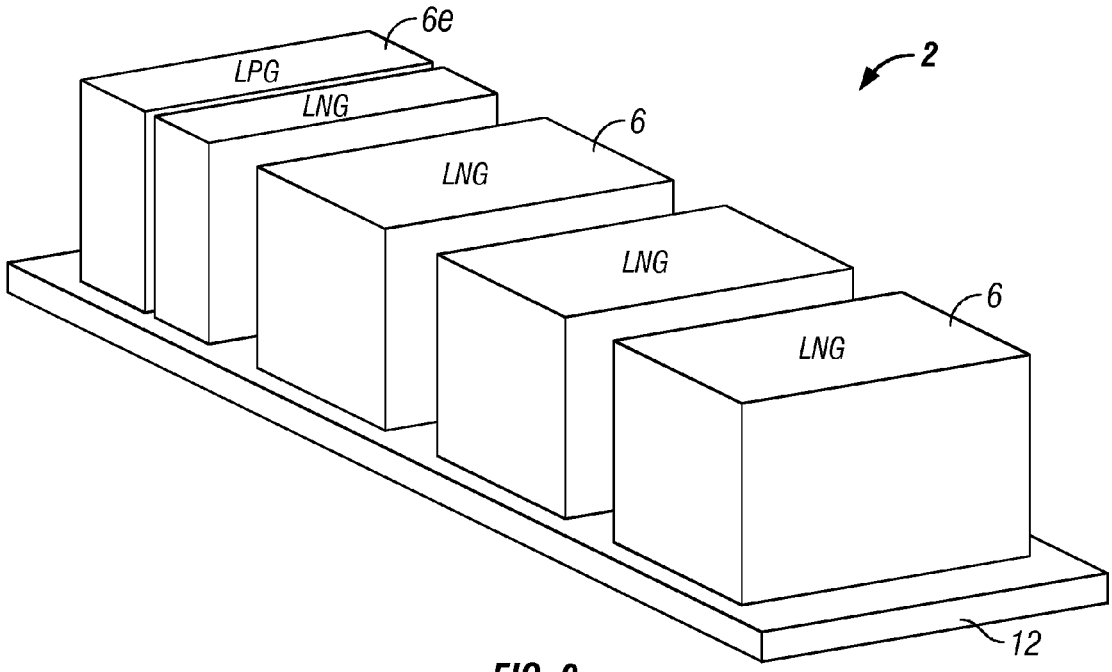
FIG. 9 is a schematic top perspective view of an internal portion of the vessel of FIG. 7, showing storage tanks.
Figure 10:
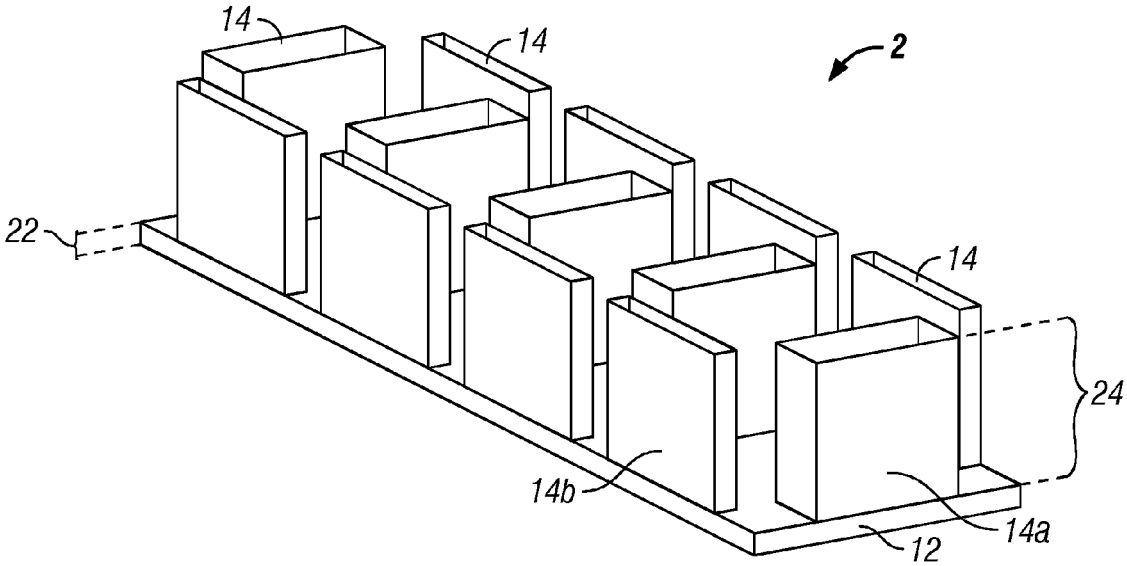
FIG. 10 is a schematic top perspective view of the vessel of FIG. 7, showing variable ballast portions.

FIG. 9 is a schematic top perspective view of an internal portion of the vessel of FIG. 7, showing storage tanks. As shown, the tanks 6 can be disposed above the fixed ballast portion 12. FIG. 10 is a schematic top perspective view of the vessel of FIG. 7, showing variable ballast portions. The figures will be described in conjunction with each other. Generally, the tanks 6 can be separated, for example with spaces therebetween where the spaces can provide variable ballast portions 14 to the vessel 2. In some embodiments, the production of the LNG can also produce liquefied petroleum gas (LPG). One or more of the tanks 6, such as tank 6*e*, can be used for storage of the LPG.

The variable ballast portions 14*a*, 14*b* are shown at the second elevation 24 above the fixed ballast portion 12 at the first elevation 22. The variable ballast portions 14 can at least partially surround the tanks 6, such as to protect the tanks 6. Thus, by comparing FIG. 9 with FIG. 10, it can be shown that the tanks 6 can be disposed between the various variable ballast portions 14.

The various methods and embodiments of the invention can be included in combination with each other to produce variations of the disclosed methods and embodiments, as would be understood by those with ordinary skill in the art, given the understanding provided herein. Also, various aspects of the embodiments could be used in conjunction with each other to accomplish the understood goals of the invention. Also, the directions such as "top," "bottom," "left," "right," "upper," "lower," and other directions and orientations are described herein for clarity in reference to the figures and are not to be limiting of the actual device or system or use of the device or system. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally. Unless the context requires otherwise, the word "comprise" or variations such as "comprises" or "comprising", should be understood to imply the inclusion of at least the stated element or step or group of elements or steps or equivalents thereof, and not the exclusion of a greater numerical quantity or any other element or step or group of elements or steps or equivalents thereof The device or system can be used in a number of directions and orientations. Further, the order of steps can occur in a variety of sequences unless otherwise specifically limited. The various steps described herein can be combined with other steps, interlineated with the stated steps, and/or split into multiple steps. Additionally, the headings herein are for the convenience of the reader and are not intended to limit the scope of the invention.

The invention has been described in the context of various embodiments and not every embodiment of the invention has been described. Apparent modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect all such modifications and improvements to the full extent that such falls within the scope or range of equivalent of the following claims.

Further, any references mentioned in the application for this patent as well as all references listed in the information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicants.

The invention claimed is:

1. A semi-submersible floating storage vessel, comprising:

a fixed ballast portion disposed at a first elevation;

a hydrocarbon storage tank disposed at a second elevation above the first elevation and coupled to the fixed ballast portion;

a plurality of columnar supports spaced apart from each other and configured to allow waves to pass therebetween, the columnar supports being vertically coupled to the fixed ballast portion and disposed between the first elevation and a third elevation above the second elevation;

a variable ballast portion disposed above the first elevation and coupled to the storage tank, wherein the variable ballast portion at least partially surrounds the hydrocarbon storage tank; and a deck coupled to at least some of the plurality of the columnar supports and disposed above the third elevation.

2. The vessel of claim 1, wherein the second elevation is below water level when the vessel is semi-submerged and the columnar support extends above the water level to the deck above the water level.

3. The vessel of claim 1, wherein the variable ballast portion defines a capacity of one-half of a volume of a hydrocarbon storage capacity in the hydrocarbon storage tank.

4. The vessel of claim 1, wherein the variable ballast portion is at least partially formed inside the columnar support.

5. The vessel of claim 1, further comprising an intermediate deck disposed at least partially above the storage tank and adapted to allow access by personnel to the storage tank when the storage tank is submerged.

6. The vessel of claim 1, wherein the fixed ballast portion comprises fixed ballast.

7. The vessel of claim 1, wherein the variable ballast portion is adapted to have ballast weighing up to a stored weight of liquefied natural gas.

8. A method of storing hydrocarbons offshore, comprising:

providing a vessel as claimed in claim 1, wherein the storage tank is not completely full of hydrocarbons;

determining first and second desired drafts;

ballasting the variable ballast portion so that the first draft is established;

adding hydrocarbons to the storage tanks; and ballasting the variable ballast portion so that the second draft is established.

9. A vessel for use in offshore hydrocarbon production, comprising:

a fixed ballast portion having a top and a bottom and disposed at a first sub-sea elevation;

at least one hydrocarbon storage tank coupled to the top of the fixed ballast portion;

a plurality of vertical support members spaced apart from each other and configured to allow waves to pass therebetween, each support member having a sub-sea end coupled to the top of the fixed ballast portion and an elevated end extending above the sea surface;

at least one variable ballast portion coupled to the top of the fixed ballast portion, wherein the variable ballast portion at least partially surrounds the hydrocarbon storage tank; and a deck having a top surface and coupled to at least some of the plurality of vertical support members so that the top surface is above the sea surface.

10. The vessel of claim 9, wherein the at least one variable ballast portion defines a capacity of one-half of a volume of a hydrocarbon storage capacity of the at least one hydrocarbon storage tank.

11. The vessel of claim 9, further comprising an intermediate deck disposed at least partially above the at least one hydrocarbon storage tank.

12. The vessel of claim 11, wherein the intermediate deck allows access to the at least one hydrocarbon storage tank by personnel while the storage tank is submerged.

13. The vessel of claim 9, wherein the at least one variable ballast portion has enough volume to contain ballast weighing up to a stored weight of liquefied natural gas.

14. The vessel of claim 9, wherein the variable ballast portion is at least partially formed inside one or more of the vertical support members.

15. A method of storing hydrocarbons offshore, comprising:

providing a vessel as claimed in claim 9, wherein the one or more storage tanks are not completely full of hydrocarbons;

determining first and second desired drafts;

ballasting the at least one variable ballast portion so that the first draft is established;

adding hydrocarbons to the one or more storage tanks; and ballasting the at least one variable ballast portion so that the second draft is established.

16. The method of claim 15, wherein ballasting the at least one variable ballast portion includes adding water thereto or removing water therefrom.

17. The method of claim 15, wherein the first and second drafts are the same.

18. The method of claim 15, wherein the variable ballast portion is at least partially formed inside one or more of the vertical support members and wherein ballasting the at least one variable ballast portion includes changing the volume of ballast in at least a portion of the interior of one or more support members.

* * * * *